United States Patent [19]

Bardash et al.

[11] 4,093,153

[45] June 6, 1978

[54] GROUND-CONTROLLED GUIDED-MISSILE SYSTEM

[75] Inventors: Manuel L. Bardash, Willingboro; Carl P. Clasen, Cherry Hill; Robert M. Scudder, Haddonfield; Lawrence H. Simon, Cherry Hill; Charles S. Sorkin, Cherry Hill; Raphael O. Yavne, Cherry Hill, all of N.J.; Robert W. Ekis, Athens, Ala.; Alfred I. Mintzer, Lexington, Mass.

[73] Assignee: The United States of America as represented by the Secretary of the Army, Washington, D.C.

[21] Appl. No.: 508,605

[22] Filed: Nov. 18, 1965

[51] Int. Cl.[2] ..... F41G 7/14

[52] U.S. Cl. ..... 244/3.14

[58] Field of Search ..... 244/3.11, 3.14, 3.19; 343/7, 7.4, 5 D, 5 P; 89/41.7 R

[56] References Cited

U.S. PATENT DOCUMENTS

| | | | |
|---|---|---|---|
| 2,399,426 | 4/1946 | Bradley | 89/41.7 R |
| 2,950,477 | 8/1960 | Alpers | 244/3.14 |
| 3,130,402 | 4/1964 | Kuck | 343/7.4 |
| 3,168,264 | 2/1965 | Sendles | 244/3.14 |
| 3,169,727 | 2/1965 | Schroader et al. | 244/3.13 |

OTHER PUBLICATIONS

Drewry, I. O., The Brand Name is Nike X, In *Army,* pp. 52–55, Feb. 1964.

Guided Missile Fundamentals, AF Manual 52–31, pp. 268, 408, 483 and 484, Feb. 19, 1968.

*Primary Examiner*—Verlin R. Pendegrass

*Attorney, Agent, or Firm*—Nathan Edelberg; Robert P. Gibson; James T. Deaton

[57] ABSTRACT

A mobile missile system that is automatic in operation and that is designed to simultaneously defend against a multiplicity of air born targets as well as moving ground targets by using a time-sharing radar installation that performs the functions of acquisition, tracking and discrimination of the targets, simultaneous tracking of discrete units of the targets, transmission of command signals to the launchers for launching the missiles, and command control of the missiles after the launch, all on the same time-sharing basis.

17 Claims, 2 Drawing Figures

GROUND-CONTROLLED GUIDED-MISSILE SYSTEM

Figure 1:
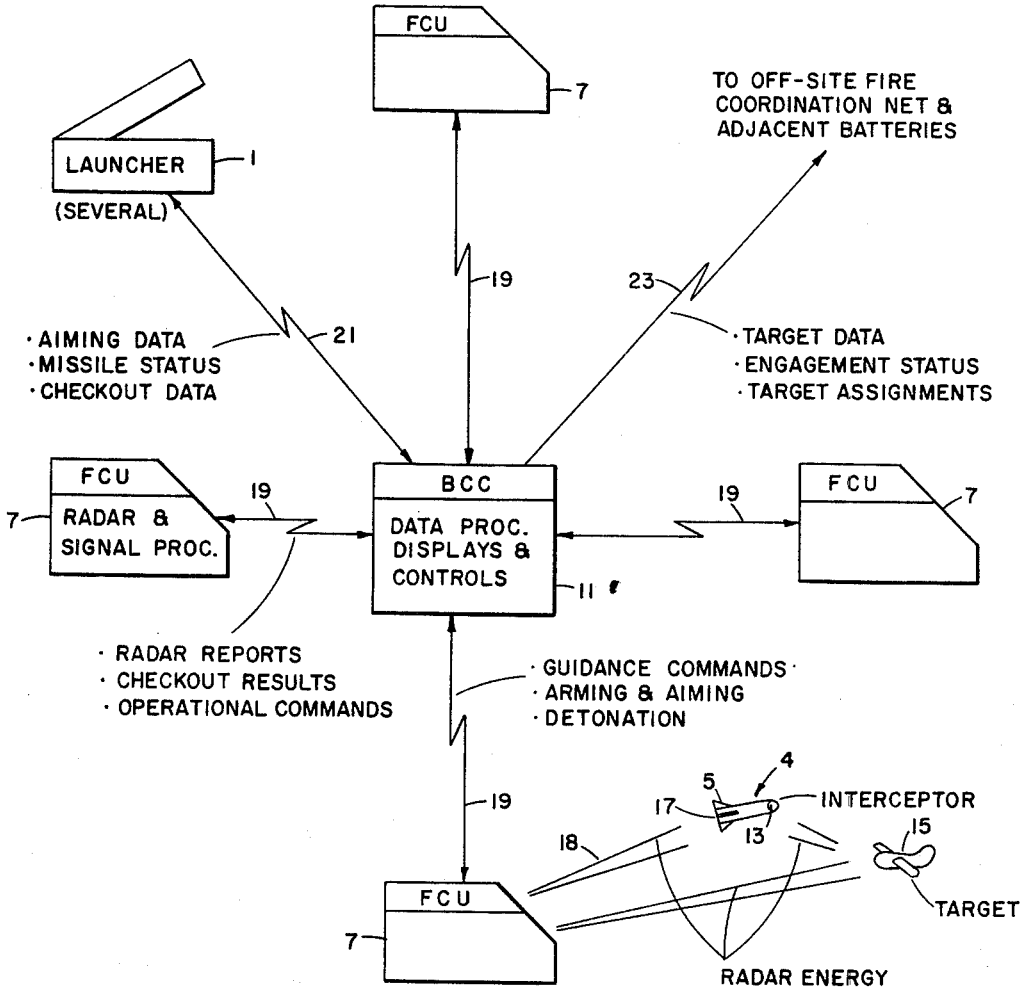

The need for an air defense system which is capable of substantially simultaneously engaging a multiplicity of air born targets has existed for some time. However, before the invention of phased array radar, such a defence system was not feasible. With the old types of conventional radar, it was possible to track and engage a multiplicity of targets with a multiplicity of radar units. With this old type radar, a defence system could be easily over ridden with a multiplicity of air born targets due to the time required for each engagement. However, with a system that includes phased array radar as disclosed herein it is possible to selectively engage a multiplicity of targets, which may even be arranged in cloud formations with decoy targets, with a multiplicity of interceptors and thereby defeat the threat of a multiplicity of targets.

In a defense system of this type, there is also a need for self protection against moving ground targets that may be a threat to the defense system.

Therefore, it is a primary object of this invention to provide a defense system for protection against a plurality of air born targets as well as moving ground targets.

Another object of this invention is to provide a defense system that utilizes a phased array radar that performs the functions of search, target track and interceptor track all on a time sharing basis, and is capable of performing these functions substantially simultaneously on a multiplicity of targets, advancing from different directions and in cloud formation.

A further object of this invention is to provide a missile system that is completely mobile. A still further object of this invention is to provide a missile system that has wireless communication means.

Still another object of this invention is to provide a missile system that requires a minimum amount of time to set up and put into operation.

A still further object of this invention is to provide a missile system that utilizes command control guidance.

In accordance with this invention, the missile system is composed of:

(a) A plurality of solid propellant missiles each containing guidance mechanism suitable for surface-to-air and surface-to-ground mission, (b) each missile containing a bistatic radar and suitable electronics for maintaining coherent relationships amongst the reference and error signals while time-sharing the electronics used to communicate with the ground system, (c) a means of launching these missiles, (d) a multi-function ground radar installation capable of (1) propagating to and receiving from a plurality of targets usable signals and waveforms suitable for surveillance and tracking, and (2) selectively transmitting command signals derived from said surveillance and tracking sigbals to the guided missiles all on a time-sharing basis, and (e) a data-processing installation operatively associated with said radar and launching installations and capable of translating said time-shared surveillance and tracking signals from the ground radar and bistatic radar signals into time-shared command signals suitable for transmission to, and used for, control of the missile and its warhead.

The system has full tactical mobility in that the launching means, the radar installation, and the data-processing installation are contained in separate self-sufficient mobile units. For special missions, the data-processing equipment and the radar may be contained in the same self-sufficient mobile unit and deployed separately with associated launcher units.

Figure 2:
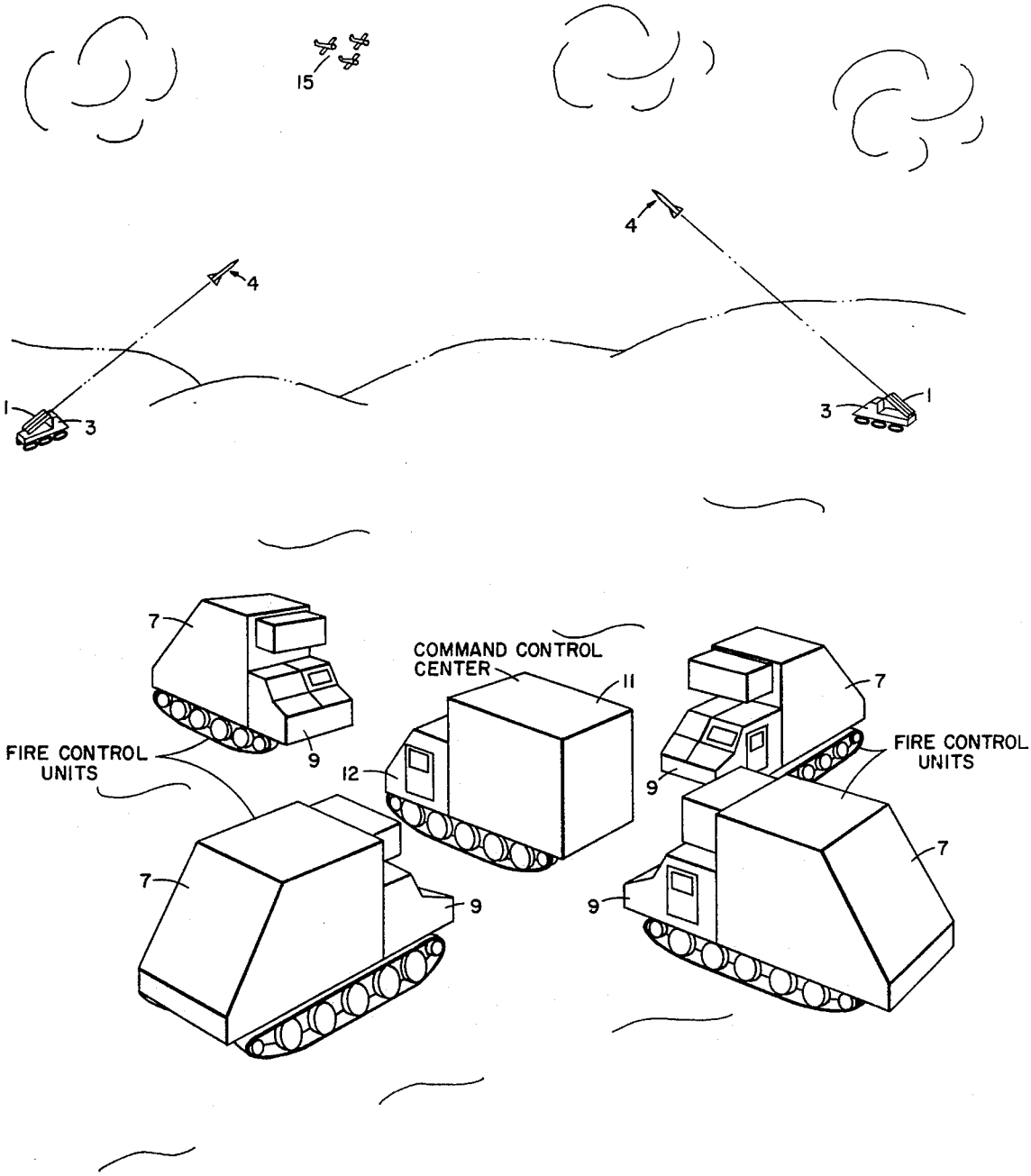

In the accompanying drawing forming a part of this specification, and in which like numerals are employed to designate corresponding parts throughout the same:

FIG. 1 is a diagramatic illustration of a missile system according to this invention; and FIG. 2 is a perspective view illustrating the overall components and mobility of the system.

The invention may be better understood by referring to the drawing in which FIG. 2 illustrates a missile system with the components thereof set up for defending an area. The components include a plurality of launchers 1 (only two of which are illustrated) mounted on track vehicles 3, four fire control units 7 with each mounted on a track vehicle 9, and a command and control center 11 mounted on track vehicle 12 and centrally located relative to the fire control units. The particular elements in each of the components are more completely set forth below.

The Launcher

Each launcher 1 is normally carried on a carrier vehicle 3 but may be demounted to release the carrier vehicle for other purposes. In firing position, the launcher is trainable in azimuth over a full 360° and has an elevation control system which maintains the elevation angle fixed (at substantially 60°). The launcher is lowered to a horizontal position for travel and reloading.

Each launcher 1 has a plurality of missiles 4 (nominally five to a launcher) supported in their containers which also serve as launching rails. The launcher carries its own handling gear for reloading and charging warheads. Each container is sealed and maintained at slight positive pressure to provide protection for the missile during long-term storage. The end covers for each container are removed upon installation on the launcher, and environmental protection is maintained by frangible diaphragms until firing.

The Missile

Each missile 4 is a solid-propellant high performance interceptor. Tail control surfaces 5 on the missile (see FIG. 1) provide yaw, pitch, and roll control. Each of the four control surfaces is independently positioned by individual servo-actuators to provide pitch and yaw maneuvering. The missile is roll stabilized.

Two radar antenna systems are provided on the missile: a forward antenna 13 designed to pick up bistatic reflections from the target 15; and a rear antenna 17 to provide a link 8 between ground sensor fire control unit 7 and interceptor 4.

The major electronic subsystems of the missile are the airborne sensor, the missile electrical power supply, gyro servo amplifier and missile electroexplosive devices. All sub-units are hermetically sealed to provide isolation from vibration and temperature. Solid state components are employed wherever feasible.

The missile electronics has three basic functions: to coherently amplify and transpond tracking signals to the ground, to receive, decode, and process commands, and to receive and process in a bistatic link, skin reflections from the target and coherently transmit the reference and error signals to the ground, and to receive and re-transmit jamming signals originating from the target for cross-correlation with these jamming signals as seen by the ground sensor. The error signals of bistatic receiver 13 are delayed with respect to the reference signals by appropriate and carefully controlled delay lines so that time multiplexing may be used in transmission.

The Fire Control Unit

The Fire Control Units 7 (FCU) house the multi-function radar and its related signal processor. Each FCU 7 nominally is assigned to a quarter hemisphere region of space in which it performs:

(1) Surveillance and detection
(2) Target tracking
(3) Missile (interceptor) tracking
(4) Missile (interceptor) command, safety destruct, and fuzing
(5) Reception of bistatic target reflections, target jamming signals, and coded data all relayed from the interceptor.

This multi-function radar derives its high degree of flexibility by utilizing inertialess scanning of the phase steering and/or frequency steering techniques or a combination of both. This technique has a capability of changing the direction of radiation (and reception) of energy in, essentially, zero time (a few microseconds). This ability to change direction coupled with a capability of changing waveform and repetition frequency to optimally match the desired mode (track, configuration, surveillance, etc.) provides a highly versatile multi-function sensor. A large number of targets requiring a variety of radar modes for proper handling, may be automatically maintained on a time-shared basis. This same antenna may be used for all up-link and down-link communications with the missiles.

A signal processor contained in the FCU 7 is used to control the radar and to process the direct and bistatic target returns and also the missile tracking returns. Coherent signal processing is used where appropriate and the results of all processing is transmitted to a computer (nominally located in the BCC 11).

As a means of improving performance in a jamming environment, auxiliary antennas are used to provide side-lobe inputs to a signal processor correlator for purposes of cancelling jamming signals appearing in the main beam. These auxiliary antenna utilize horns in the main steerable array and, thus, are not separate equipments. The signal processor, as mentioned before, will also cross-correlate target originated jamming signals seen by both the ground sensor 7 and the airborne sensor to facilitate the location of these jamming sources.

Solid state microelectronics are used where feasible and packaging and mounting techniques are used to provide maximum protection against shock, vibration, and other environmental factors. The FCU 7 may be utilized while on its carrier vehicle 9 thus minimizing emplacement time.

The Battery Control Center

Overall coordination, control, and command of a battery is accomplished by a combination of data-processing equipments and operators located in the Battery Control Center 11 (BCC). The BCC 11 is a self-contained data-processing, display, and communications center. The central computer is a digital stored program device combining data received from the ground sensor, the air borne sensor, the communication system (especially IFF), and operators with stored a prior knowledge to determine the proper radar modes to evaluate the threat situation, to determine the proper engagement reaction for a threat, to properly guide the missile to a sucessful destructionn of the target which may be air-supported or a Tactical Ballistic Missile (TBM) and may be seen in a benign or in a jamming environment, to correctly aim and fire the warhead at the proper time, to provide for inter and intra battery and surface-to-surface mission control, and to perform system and self checkout, monitoring, and diagnosis. Data must be prepared in proper form and format for display to an operator; and operator inputs which may be commands, instructions, or pertinent data must be recognized and utilized properly.

The equipments in the BCC employ solid state microelectronics where feasible and are packaged and mounted for maximum protection against shock, vibration, and other environmental factors. The BCC shelter may be utilized while emplaced on its own carrier vehicle thus providing maximum flexibility with minimal setup time.

Communications between the BCC 11 and FCU 7 are via a microwave link 19. The BCC communications with Launchers 1 are by very high frequency (VHF) link 21 with security and jamming protection circuits. Similar VHF links 23 provide extra-battery communications with off-site fire coordination net and adjacent batteries.

It is to be understood that the form of our invention, herewith shown and described, is to be taken as a preferred example of the same, and that various changes in the arrangement of parts may be resorted to, without departing from the spirit of our invention, or the scope of the subjoined claims.

We claim:

1. A missile system for defense against ground targets and clouds of incoming targets and decoys, comprising: launchers with missiles mounted thereon and disposed for positioning on locations for launching said missiles; and a time-sharing radar installation disposed for performing the functions of acquisition, tracking and discrimination of the targets, simultaneous tracking of discrete units of the targets, transmission of command signals to said launchers for launching said missiles, and command control of said missiles after the launch, all on the same time-sharing basis.

2. A missile system as set forth in claim 1 wherein, said missiles contain guidance mechanisms for surface-to-air and surface-to-ground missions, a bistatic radar for receiving reflected signals from the target, and suitable electronic means for receiving the signals from said bistatic radar and transmitting the received signals to said time sharing radar, and for receiving transmitted signals from said time sharing radar to control said guidance mechanism and thereby said missiles.

3. A missile system as set forth in claim 1 wherein, said missile system is made up of components that are mounted on vehicles to make the system completely mobile.

4. A missile system as set forth in claim 3 wherein, said system is operable when on or off said vehicles.

5. A missile system as set forth in claim 1 wherein, said time-sharing radar installation includes four fire control units with each of the units arranged for a quarter hemisphere protection and a command control center located centrally of said fire control units.

6. A missile system as set forth in claim 5 wherein, said command control center is in communication with the launchers and fire control units through wireless communication means.

7. A missile system as set forth in claim 1 wherein, said time-sharing radar is multi-function radar that is steered by at least one of the techniques of phase steering and frequency steering.

8. A missile system including: missile launching means having a plurality of missiles mounted thereon, said missiles containing guidance mechanism and electronic communication means for controlling said guidance mechanism; a multi-function radar installation; and data-processing means operatively associated with said radar installation and said launching means, said data-processing means, being capable of translating time-shared surveillance and tracking signals from the radar and radar signals from the missiles into time-shared command signals suitable for transmission to and used in controlling the missiles, said multi-function radar installation performing the functions of acquisition, tracking and discrimination of targets, simultaneous tracking of discrete units of the targets, transmission of command signals to said launchers for launching said missiles, and command control of said missiles after launching, all on the same time-sharing basis.

9. A missile system as set forth in claim 8 wherein, said missiles include surface-to-air and surface-to-ground missiles, and said multi-function radar installation is capable of detecting moving ground targets as well as air born targets.

10. A missile system as set forth in claim 9 wherein, said missile launching means, said multi-function radar installation, and said data processing means are separate units that are transportable to make the system completely mobile.

11. A missile system as set forth in claim 10 wherein, wireless communication means communicate said data processing means with the multi-function radar installation and the launching means.

12. A missile system as set forth in claim 8 wherein, each said launching means has five missiles mounted thereon, and said multi-function radar installation includes four radar units arranged for each radar unit to defend a quarter hemisphere.

13. A missile system as set forth in claim 12 wherein, said data-processing means is communicated with said multi-function radar installation by microwave link means, and with said launching means by very high frequency link means.

14. A missile system as set forth in claim 13 wherein, said radar units, said data processing means, and said launching means are mounted on land vehicles.

15. A missile system as set forth in claim 14 wherein, said missile system is operable when mounted on said land vehicles and when removed therefrom.

16. A missile system including: a control center; a fire control unit having phased array radar therein capable of performing the functions of searching, target tracking of a plurality of targets, and missile tracking of a plurality of missiles all on a time-sharing basis; a launcher with a plurality of missiles thereon; and wireless communication means interconnecting the control center with the fire control unit and the launcher for controlling and processing information to and from the fire control unit and the launcher.

17. A ground-controlled guided missile system comprising: a plurality of solid propellant missiles each containing a surface-to-air and surface-to-surface guidance mechanism adapted to be actuated by radiant energy; launching means for said missiles; a time-sharing radar installation capable of propagating to and receiving from a plurality of targets surveillance and tracking signals and transmitting command signals derived from said surveillance and tracking signals, all on the same-time-sharing basis; a data-processing installation operatively associated with said radar installation and capable of translating said time-shared surveillance and tracking signals into time-shared command signals; and means including said radar installation for transmitting said command signals selectively to said plurality of missile-guidance mechanisms.

* * * * *